US008940242B2

(12) United States Patent
Chen et al.

(10) Patent No.: US 8,940,242 B2
(45) Date of Patent: Jan. 27, 2015

(54) MULTI-ZONED CATALYST COMPOSITIONS

(75) Inventors: Shau-Lin F. Chen, Piscataway, NJ (US); Dennis R. Anderson, Plainsboro, NJ (US)

(73) Assignee: BASF Corporation, Florham Park, NJ (US)

( * ) Notice: Subject to any disclaimer, the term of this patent is extended or adjusted under 35 U.S.C. 154(b) by 698 days.

(21) Appl. No.: 12/761,873

(22) Filed: Apr. 16, 2010

(65) Prior Publication Data

US 2010/0263358 A1 Oct. 21, 2010

Related U.S. Application Data

(60) Provisional application No. 61/170,251, filed on Apr. 17, 2009.

(51) Int. Cl.

| | |
|---|---|
| ***B01D 50/00*** | (2006.01) |
| ***F23J 11/00*** | (2006.01) |
| ***F02M 25/06*** | (2006.01) |
| ***F01N 3/28*** | (2006.01) |
| ***F01N 3/08*** | (2006.01) |

(52) U.S. Cl.

CPC ..... *F01N 3/2828* (2013.01); *F01N 3/08* (2013.01); *F01N 3/0814* (2013.01); *F01N 3/0835* (2013.01); *F01N 3/0864* (2013.01); *F01N 2330/06* (2013.01); *F01N 2330/60* (2013.01); *F01N 2510/0682* (2013.01); *F01N 2250/12* (2013.01); *F01N 2330/30* (2013.01); *F01N 2510/0684* (2013.01)

USPC ..... 422/177; 422/168; 60/279

(58) Field of Classification Search

None

See application file for complete search history.

(56) References Cited

U.S. PATENT DOCUMENTS

| | | | |
|---|---|---|---|
| 5,254,519 | A | 10/1993 | Wan et al. |
| 5,538,697 | A | 7/1996 | Abe et al. |
| 5,597,771 | A | 1/1997 | Hu et al. |
| 5,772,972 | A | 6/1998 | Hepburn et al. |
| 5,898,014 | A | 4/1999 | Wu et al. |
| 5,916,133 | A | 6/1999 | Buhrmaster et al. |
| 5,948,377 | A | 9/1999 | Sung |
| 5,948,723 | A | 9/1999 | Sung |
| 5,981,427 | A | 11/1999 | Sung et al. |
| 5,989,507 | A | 11/1999 | Sung |
| 6,087,298 | A | 7/2000 | Sung et al. |
| 6,110,862 | A | 8/2000 | Chen et al. |
| 6,248,688 | B1 | 6/2001 | Wu et al. |
| 6,277,784 | B1 | 8/2001 | Kruse |
| 6,375,910 | B1 | 4/2002 | Deeba et al. |

(Continued)

FOREIGN PATENT DOCUMENTS

JP 07-232084 9/1995

*Primary Examiner* — Melvin C Mayes
*Assistant Examiner* — Sheng H Davis
(74) *Attorney, Agent, or Firm* — Melanie L. Brown

(57) ABSTRACT

Exhaust gas treatment substrates, and systems and methods including the same are provided. Catalyst substrates having flow properties where in configuring an outer, peripheral zone, more exhaust gas flows through a central zone as compared to the outer, peripheral zone. The outer, peripheral zone can have a trapping or adsorbing material on surfaces of its passages, or it can have a longer axial length as compared to the inner zone, or its passages can have smaller openings as compared to the inner zone. In one embodiment, an overcoat containing a trapping material such as a hydrocarbon trap is applied to an inlet end. In another embodiment, catalyst having an oxygen storage component is applied to an outlet end.

23 Claims, 2 Drawing Sheets

(56) References Cited

U.S. PATENT DOCUMENTS

| | | | | |
|---|---|---|---|---|
| 6,444,610 | B1 | 9/2002 | Yamamoto | |
| 6,492,297 | B1 | 12/2002 | Sung | |
| 6,524,992 | B2 | 2/2003 | Mussmann et al. | |
| 6,625,976 | B1 | 9/2003 | Andersen et al. | |
| 6,680,036 | B1 | 1/2004 | Fisher et al. | |
| 6,692,712 | B1 | 2/2004 | Andersen | |
| 6,764,665 | B2 | 7/2004 | Deeba et al. | |
| 6,777,370 | B2 | 8/2004 | Chen | |
| 6,923,945 | B2 | 8/2005 | Chen | |
| 7,022,646 | B2 | 4/2006 | Li | |
| 7,189,376 | B2 | 3/2007 | Kumar et al. | |
| 7,238,217 | B2 * | 7/2007 | Cutler et al. | 55/523 |
| 2001/0036432 | A1 | 11/2001 | Hu et al. | |
| 2002/0162319 | A1 * | 11/2002 | Crocker et al. | 60/274 |
| 2003/0097834 | A1 * | 5/2003 | Gabe et al. | 60/297 |
| 2003/0175192 | A1 | 9/2003 | Hu et al. | |
| 2004/0001782 | A1 * | 1/2004 | Kumar et al. | 422/180 |
| 2004/0131512 | A1 * | 7/2004 | Abe et al. | 422/180 |
| 2004/0138052 | A1 * | 7/2004 | Van Rooijen et al. | 502/60 |
| 2004/0223897 | A1 | 11/2004 | Yeo | |
| 2005/0107244 | A1 | 5/2005 | Ichikawa et al. | |
| 2005/0164879 | A1 | 7/2005 | Chen | |
| 2005/0227867 | A1 | 10/2005 | Chen et al. | |
| 2005/0282701 | A1 | 12/2005 | Foong et al. | |
| 2006/0059878 | A1 * | 3/2006 | Bardon et al. | 55/523 |
| 2007/0014705 | A1 | 1/2007 | Chen | |
| 2007/0093382 | A1 | 4/2007 | Vanderspurt | |
| 2007/0196248 | A1 * | 8/2007 | Mizutani | 422/180 |
| 2008/0110341 | A1 | 5/2008 | Ketcham et al. | |
| 2008/0171650 | A1 * | 7/2008 | Alward et al. | 502/80 |
| 2008/0314034 | A1 * | 12/2008 | Arnold et al. | 60/299 |
| 2010/0180581 | A1 * | 7/2010 | Grubert et al. | 60/297 |

* cited by examiner

MULTI-ZONED CATALYST COMPOSITIONS

CROSS-REFERENCE TO RELATED APPLICATIONS

This application claims priority under 35 U.S.C. §119 (e) to U.S. patent application Ser. No. 61/170,251, filed Apr. 17, 2009, which is hereby incorporated by reference in its entirety.

TECHNICAL FIELD

This invention pertains generally catalyst substrates having flow properties where in configuring an outer, peripheral zone, more exhaust gas flows through a central zone as compared to the outer, peripheral zone. Such substrates provide catalytic functions as well as trapping and/or adsorbing properties. The invention also relates to exhaust gas treating systems that incorporate such catalyst substrates.

BACKGROUND

Catalytic converters are well known for the removal and/or conversion of the harmful components of exhaust gases. For gasoline engines, they typically contain a three-way conversion (TWC) catalyst and are located in the exhaust gas line of internal combustion engines. Such catalysts promote the oxidation by oxygen in the exhaust gas stream of unburned hydrocarbons and carbon monoxide as well as the reduction of nitrogen oxides to nitrogen. For diesel engines, which run under lean operating conditions, a diesel oxidation catalyst (DOC), which promotes oxidation of unburned hydrocarbons and carbon monoxide, is usually provided.

Catalytic converters have a variety of constructions for this purpose. In one form, the converter comprises a rigid skeletal monolithic substrate on which there is a catalytic coating. The monolith has a honeycomb-type structure which has a multiplicity of longitudinal passages, typically in parallel, to provide a catalytically coated body having a high surface area.

Monolithic honeycombs containing different catalyst compositions are disposed in zones along the length of the honeycomb are used in catalytic combustion processes. Layered catalyst structures can be made on ceramic and metallic monolith structures by a variety of processes. Multi-zoned catalyst and trap are provided in U.S. Pat. No. 7,189,376 (Kumar). Automotive hydrocarbon adsorber systems are provided in U.S. Pat. No. 5,916,133 (Buhrmaster).

In exhaust gas lines, limited piping space, for example at an elbow, between the engine and a catalytic converter and lead to mal-distribution of flow through the catalytic converter. This mal-distribution of flow affects catalyst efficiency and conversions during transient conditions.

In order to meet ever more stringent emission standards set by various regulatory agencies, such as the proposed SULEV emissions regulations, there is a benefit to develop catalyst architectures that assist and advance light-off of, for example, three-way conversion catalyst light-off. In addition, it is desirable to refine zone-coating technologies and evaluate placement of particular catalytic or pollutant adsorbent compositions along the catalyst's length and radius.

SUMMARY

One or more aspects of the present invention relate to an exhaust gas treatment catalyst composite, and systems and methods including the same. Generally, the exhaust gas treatment catalyst composite comprises:

a substrate comprising first and second pluralities of longitudinal passages wherein the first plurality of passages define an inner radial zone and the second plurality of passages define an outer radial zone, wherein internal surfaces of the first and second pluralities of longitudinal passages comprise at least one catalytic layer comprising a catalytic metal on a support, and the second plurality of passages are configured such that more exhaust gas flows through the first plurality of passages as compared to the second plurality of passages.

By directing more exhaust gas through the outer radial zone, light-off can be advanced in a way that does not change precious metals distribution of the catalytic material. In this way, change in flow of the exhaust gas is achieved in ways that are independent of the automobile operating system and the catalyst formulation.

In a specific embodiment, the internal surfaces of the second plurality of passages further comprise a layer comprising a trapping or adsorbing material in the absence of precious metals and the internal surfaces of first plurality of passages are substantially free of the trapping or adsorbing material.

In another embodiment, the internal surfaces of the first and second plurality of passages both further comprise a layer comprising a trapping or adsorbing material in the absence of precious metals, and the second plurality of passages have a longer average axial length as compared to the first plurality of passages.

DETAILED DESCRIPTION

Figure 1:
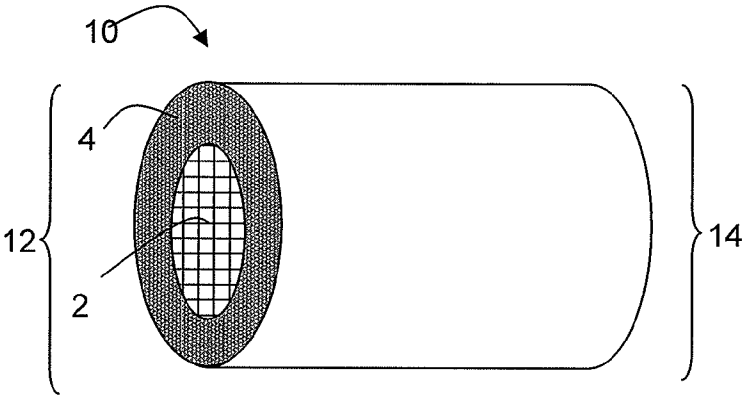
FIG. 1 is a schematic of a substrate in accordance with an embodiment of the present invention.

One or more embodiments of the present invention contain a substrate coated with a precious metal-containing catalytic material, e.g., a catalytic converter for use with internal combustion engines, having a radial-zoned perimeter configured to create differential back pressure and to force more exhaust flow through a central region of the catalytic converter so that during cold start, light-off can be advanced. In this way, more convective heat will be concentrated in the central region to promote a faster heat-up rate. The differential back pressure can be created in many ways, for example, the radial-zoned perimeter can be coated with more washcoat material than the central region. Another option is to provide the perimeter region having a longer axial length as compared to the central region. A further option is to provide passages of smaller size in the outer region as compared to the central region. The restriction created by either the extra washcoat material or the longer axial length or the small sized-openings of the perimeter zone controls back-pressure and increases flow into the cross-section area of the catalytic material. This can lead to reduced mal-distribution of flow through the catalytic material caused by limited piping space, e.g., elbow, between an engine and the catalytic converter. These configurations provide ways to alter flow that are independent of the operating system and the original precious-metal containing catalyst formulation. By concentrating flow though a central region of the substrate, a perimeter area aids in providing an insulated zone to help prevent heat loss.

Reference to "downstream" and "upstream," when used to describe a catalyst substrate or zone, refers to the relative positions in the exhaust system as sensed in the direction of the flow of the exhaust gas stream. "Inlet" refers to the end of the substrate where exhaust gas enters the substrate, and "outlet" refers to the end of the substrate where exhaust gas exits the substrate.

Generally, the exhaust gas treatment catalyst composite comprises: a substrate comprising first and second pluralities of longitudinal passages wherein the first plurality of passages define an inner radial zone and the second plurality of passages define an outer radial zone, wherein internal surfaces of the first and second pluralities of longitudinal passages comprise at least one catalytic layer comprising a catalytic metal on a support, and the second plurality of passages are configured such that more exhaust gas flows through the first plurality of passages as compared to the second plurality of passages.

In a specific embodiment, the internal surfaces of the second plurality of passages further comprise a layer comprising a trapping or adsorbing material in the absence of precious metals and the internal surfaces of first plurality of passages are substantially free of the trapping or adsorbing material.

In another embodiment, the internal surfaces of the first and second plurality of passages both further comprise a layer comprising a trapping or adsorbing material in the absence of precious metals, and the second plurality of passages have a longer average axial length as compared to the first plurality of passages. In a detailed embodiment, the average length of the second plurality of passages is longer than the average length of the first plurality of passages by 1 cm or 20% of the substrate's length, whichever is less.

In one embodiment, the catalytic material comprises one or more precious metals that are suitable for treating gas exhaust streams of internal combustion engines. For example, it may be desirable to provide catalytic material suitable for three-way conversion (TWC) or diesel oxidation. The catalytic material can be composed of any compositions and layering architecture that is needed for a particular engine application.

In one embodiment, the outer radial zone comprises up to approximately 50% of the cross-sectional area of the substrate, or 36% or even 20%.

Suitable trapping or adsorbing materials that are precious-metal free include, but are not limited to, hydrocarbon traps, poison traps, oxygen storage components. The layer containing the trapping or adsorbing materials can be located above or below the catalytic layer, depending on the application. For example, a hydrocarbon trapping layer can be provided under the catalytic layer. Also, in a detailed embodiment, the layer comprising the hydrocarbon adsorbent begins from an inlet end of the substrate and extends axially for no less than the lesser of 1 cm or 20% of the substrate's length. In a detailed embodiment, provided is a hydrocarbon trap layer which comprises a molecular sieve, such as a hydrophobic zeolite. As used herein, molecular sieves, such as zeolites, refer to materials, the materials having a substantially uniform pore distribution, with the average pore size being no larger than 20 Å.

The zeolite can be a natural or synthetic zeolite such as faujasite, chabazite, clinoptilolite, mordenite, silicalite, zeolite X, zeolite Y, ultrastable zeolite Y, ZSM-5 zeolite, ZSM-12 zeolite, SSZ-3 zeolite, SAPO5 zeolite, offretite, or a beta zeolite. Preferred zeolite adsorbent materials have a high silica to alumina ratio. The zeolite may have a silica/alumina molar ratio of from at least about 25/1, preferably at least about 50/1, with useful ranges of from about 25/1 to 1000/1, 50/1 to 500/1 as well as about 25/1 to 300/1, from about 100/1 to 250/1, or alternatively from about 35/1 to 180/1 is also exemplified. Preferred zeolites include ZSM, Y and beta zeolites. A particularly preferred adsorbent may comprise a beta zeolite of the type disclosed in U.S. Pat. No. 6,171,556. The zeolite loading should not be smaller than 0.1 g/in$^3$ in order to guarantee sufficient HC storage capacity and to prevent a premature release of stored paraffins during the temperature ramp following low temperature storage. Preferably, zeolite content is in the range of about 0.4 to about 2.0 g/in$^3$, or even 0.7 to 1.0 g/in$^3$.

In a further embodiment, the radial zone comprises an overcoat, which comprises a poison trap or sorbent. Poison trap and sorbent catalysts are known in the art. For example, a suitable poison trap overcoat is described in U.S. Patent Appl. Pub. No. 2007/0014705, incorporated herein by reference in its entirety. Poison trap overcoats contain components that interact with S—, P—, Mn—, C—, and/or Fe— containing species and maintain these poisons or heavy deposits away from precious-metal containing layers. Examples of such components include porous alumina doped with barium, calcium, strontium, magnesium, and/or cerium oxide. Other overcoat materials include NOx and/or $SO_X$ traps, for example one or more alkaline earth metal components.

Another embodiment includes the outer radial zone comprising an oxygen storage component. Such a location of the OSC provides more dampening function effect and increases the delay time to with regard to the oxygen sensor, which can be a desirable design feature. This is to preserve hydrocarbon conversion through the precious metal-containing inner radial zone. Typically, the oxygen storage component will comprise one or more reducible oxides of one or more rare earth metals. Examples of suitable oxygen storage components include ceria, praseodymia, or combinations thereof. Delivery of ceria into the layer can be achieved by the use of, for example, ceria, a mixed oxide of cerium and zirconium, and/or a mixed oxide of cerium, zirconium, and neodymium.

In an embodiment, the layer comprising the oxygen storage component begins from an outlet end of the substrate and extends axially for no less than the lesser of 1 cm or 20% of the substrate's length In another aspect, an exhaust system for treatment of an internal combustion engine exhaust stream including hydrocarbons, carbon monoxide, and other exhaust gas components, is provided having an exhaust conduit in fluid communication with the internal combustion engine via an exhaust manifold and an embodiment of the catalyst composite according to the present invention.

Another aspect of the present invention includes a method for treating exhaust gases comprising contacting a gaseous stream comprising hydrocarbons, carbon monoxide, and nitrogen oxides with an embodiment of the catalyst composite according to the present invention. Moreover, exhaust streams that contain oxygenates resulting form the use of ethanol can also be so treated.

Details of the components of a gas treatment article and system according to embodiments of the invention are provided below.

Figure 2:
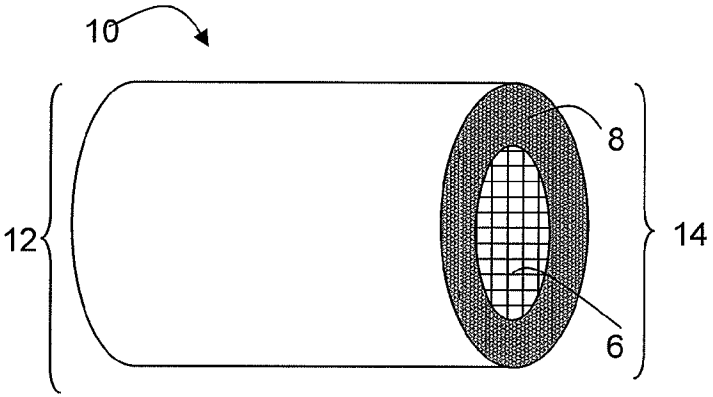
FIG. 2 is a schematic of a substrate in accordance with an embodiment of the present invention.

Referring now to FIG. 1, a substrate 10 is provided, having an inlet end 12 and an outlet end 14. In FIG. 1, the inlet end 12 has an inner radial zone 2 and an outer radial zone 4. At least one catalytic layer is provided on the internal surfaces of longitudinally extending passages that make-up both the inner radial zone 2 and the outer radial zone 4. In one embodiment, a trapping or adsorbing layer is provided on the internal surfaces of the passages of the outer radial zone 4 and along the axial length of the substrate 10. In FIG. 2, the outlet end 14 has an inner radial zone 6 and an outer radial zone 8. In another embodiment, a layer comprising an oxygen storage component is provided on the internal surfaces of the passages of the outer radial zone 6.

Figure 3:
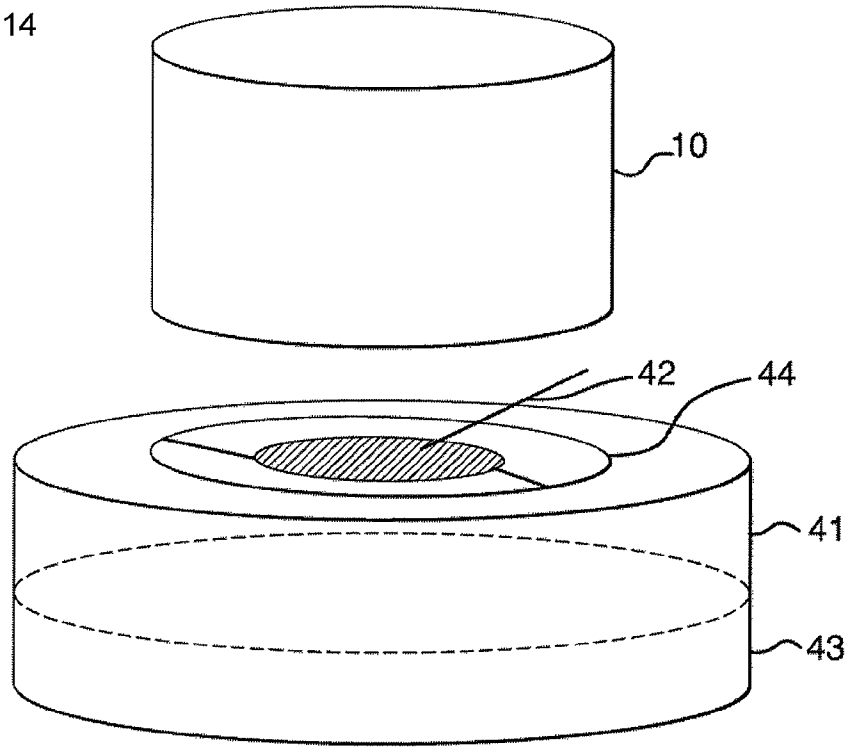
FIG. 3 is an illustration depicting a dip pan useful for coating substrates having radial zones.

One or more embodiments of the coated substrate can be selectively coated by using a modified dip pan that holds the coating slurry in the metered charge coating device. For example, as shown in FIG. 3, the dip pan can have a geometric insert with a solid central plate 42 attached to an outer ring 44 so that when a slurry 43 is drawn up the substrate 10 the outer radial core becomes coated, while the inner radial core remains uncoated. Alternatively, an adhesive surface of the desired size of the inner core can be adhered to the substrate to prevent entry of the coating slurry. The inserts of the dip pan can be modified to provide any radial zone coating profile, such as an annulus.

Figure 4B:
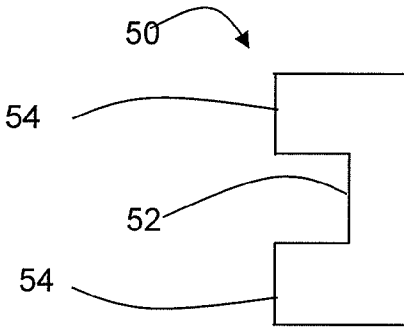
FIG. 4B is a cross-section of the schematic of FIG. 4A.
Figure 4A:
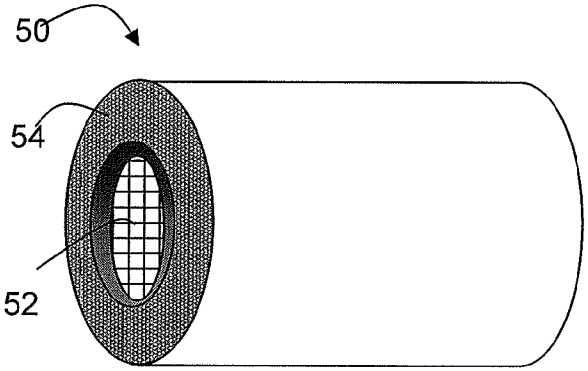
FIG. 4A is a schematic of a substrate in accordance with an embodiment of the present invention.

In FIGS. 4A and 4B, provided are a substrate 50, having an inner radial zone 52 and an outer radial zone 54, where passages of the outer radial zone 54 have a longer average axial length as compared to the passages of the inner radial zone 52. The difference in passage length creates different back pressure thereby permitting more flow through the inner radial zone as compared to the outer radial zone. Internal surfaces of passages in both zones can contain layered washcoats, where one layer is catalytically active and another layer provides trapping or adsorbing material.

The Carrier

In one or more embodiments, one or more catalyst compositions are disposed on a carrier. The carrier may be any of those materials typically used for preparing catalysts, and will preferably comprise a ceramic or metal honeycomb structure. Any suitable carrier may be employed, such as a monolithic substrate of the type having fine, parallel gas flow passages extending therethrough from an inlet or an outlet face of the substrate, such that passages are open to fluid flow therethrough (referred to as honeycomb flow through substrates). The passages, which are essentially straight paths from their fluid inlet to their fluid outlet, are defined by walls on which the catalytic material is coated as a washcoat so that the gases flowing through the passages contact the catalytic material. The flow passages of the monolithic substrate are thin-walled channels, which can be of any suitable cross-sectional shape and size such as trapezoidal, rectangular, square, sinusoidal, hexagonal, oval, circular, etc. Such structures may contain from about 60 to about 900 or more gas inlet openings (i.e., cells) per square inch of cross section.

The carrier can also be a wall-flow filter substrate, where the channels are alternately blocked, allowing a gaseous stream entering the channels from one direction (inlet direction), to flow through the channel walls and exit from the channels from the other direction (outlet direction). A dual oxidation catalyst composition can be coated on the wall-flow filter. If such a carrier is utilized, the resulting system will be able to remove particulate matters along with gaseous pollutants. The wall-flow filter carrier can be made from materials commonly known in the art, such as cordierite or silicon carbide.

The ceramic carrier may be made of any suitable refractory material, e.g., cordierite, cordierite-alumina, silicon nitride, zircon mullite, spodumene, alumina-silica magnesia, zircon silicate, sillimanite, a magnesium silicate, zircon, petalite, alumina, an aluminosilicate and the like.

The carriers useful for the catalysts of the present invention may also be metallic in nature and be composed of one or more metals or metal alloys. The metallic carriers may be employed in various shapes such as corrugated sheet or monolithic form. Preferred metallic supports include the heat resistant metals and metal alloys such as titanium and stainless steel as well as other alloys in which iron is a substantial or major component. Such alloys may contain one or more of nickel, chromium and/or aluminum, and the total amount of these metals may advantageously comprise at least 15 wt % of the alloy, e.g., 10-25 wt % of chromium, 3-8 wt % of aluminum and up to 20 wt % of nickel. The alloys may also contain small or trace amounts of one or more other metals such as manganese, copper, vanadium, titanium and the like. The surface of the metal carriers may be oxidized at high temperatures, e.g., 1000° C. and higher, to improve the resistance to corrosion of the alloys by forming an oxide layer on the surfaces of the carriers. Such high temperature-induced oxidation may enhance the adherence of the refractory metal oxide support and catalytically promoting metal components to the carrier.

In alternative embodiments, one or more catalyst compositions may be deposited on an open cell foam substrate. Such substrates are well known in the art, and are typically formed of refractory ceramic or metallic materials.

Preparation of the Layered Catalyst Composite

The layered catalyst composites used on the substrate may be readily prepared by processes well known in the prior art, see for example U.S. Patent Publication No. 2004/0001782, incorporated herein by reference in its entirety. A representative process is set forth below. As used herein, the term "washcoat" has its usual meaning in the art of a thin, adherent coating of a catalytic or other material applied to a substrate carrier material, such as a honeycomb-type carrier member, which is sufficiently porous to permit the passage there through of the gas stream being treated.

The catalyst composite can be readily prepared in layers on a monolithic carrier. For a first layer of a specific washcoat, finely divided particles of a high surface area refractory metal oxide such as gamma alumina are slurried in an appropriate vehicle, e.g., water. The carrier may then be dipped one or more times in such slurry or the slurry may be coated on the carrier such that there will be deposited on the carrier the desired loading of the metal oxide, e.g., about 0.5 to about 2.5 $g/in^3$. To incorporate components such as precious metals (e.g., palladium, rhodium, platinum, and/or combinations of the same), stabilizers and/or promoters, such components may be incorporated in the slurry as a mixture of water soluble or water-dispersible compounds or complexes. Thereafter the coated carrier is calcined by heating, e.g., at 500-600° C. for about 1 to about 3 hours. Typically, when palladium is desired, the palladium component is utilized in the form of a compound or complex to achieve dispersion of the component on the refractory metal oxide support, e.g., activated alumina. For the purposes of the present invention, the term "palladium component" means any compound, complex, or the like which, upon calcination or use thereof, decomposes or otherwise converts to a catalytically active form, usually the metal or the metal oxide. Water-soluble compounds or water-dispersible compounds or complexes of the metal component may be used as long as the liquid medium used to impregnate or deposit the metal component onto the refractory metal oxide support particles does not adversely react with the metal or its compound or its complex or other components which may be present in the catalyst composition and is capable of being removed from the metal component by volatilization or decomposition upon heating and/or application of a vacuum. In some cases, the completion of removal of the liquid may not take place until the catalyst is placed into use and subjected to the high temperatures encountered during operation. Generally, both from the point of view of economics and environmental aspects, aqueous solutions of soluble compounds or complexes of the precious metals are utilized. For example, suitable compounds are palladium nitrate or rhodium nitrate. During the calcination step, or at least during the initial phase of use of the composite, such compounds are converted into a catalytically active form of the metal or a compound thereof.

A suitable method of preparing any layer of the layered catalyst composite of the invention is to prepare a mixture of a solution of a desired precious metal compound (e.g., palladium compound or palladium and platinum compounds) and at least one finely divided, high surface area, refractory metal oxide support, e.g., gamma alumina, which is sufficiently dry to absorb substantially all of the solution to form a wet solid which later combined with water to form a coatable slurry. In one or more embodiments, the slurry is acidic, having a pH of about 2 to less than about 7. The pH of the slurry may be lowered by the addition of an adequate amount of an inorganic or an organic acid to the slurry. Combinations of both can be used when compatibility of acid and raw materials is considered. Inorganic acids include, but are not limited to, nitric acid. Organic acids include, but are not limited to, acetic, propionic, oxalic, malonic, succinic, glutamic, adipic, maleic, fumaric, phthalic, tartaric, citric acid and the like. Thereafter, if desired, water-soluble or water-dispersible compounds of oxygen storage components, e.g., cerium-zirconium composite, a stabilizer, e.g., barium acetate, and a promoter, e.g., lanthanum nitrate, may be added to the slurry.

In one embodiment, the slurry is thereafter comminuted to result in substantially all of the solids having particle sizes of less than about 20 microns, i.e., between about 0.1-15 microns, in an average diameter. The comminution may be accomplished in a ball mill or other similar equipment, and the solids content of the slurry may be, e.g., about 15-60 wt. %, more particularly about 25-40 wt. %.

Additional layers may be prepared and deposited upon the first layer in the same manner as described above for deposition of the first layer upon the carrier.

The catalytic layer may also contain stabilizers and promoters, as desired. Suitable stabilizers include one or more non-reducible metal oxides wherein the metal is selected from the group consisting of barium, calcium, magnesium, strontium and mixtures thereof. Preferably, the stabilizer comprises one or more oxides of barium and/or strontium. Suitable promoters include one or more non-reducible oxides of one or more rare earth metals selected from the group consisting of lanthanum, praseodymium, yttrium, zirconium and mixtures thereof.

A catalytic layer may also contain an oxygen storage component. Typically, the oxygen storage component will comprise one or more reducible oxides of one or more rare earth metals. Examples of suitable oxygen storage components include ceria, praseodymia, or combinations thereof. Delivery of ceria into the layer can be achieved by the use of, for example, ceria, a mixed oxide of cerium and zirconium, and/or a mixed oxide of cerium, zirconium, and neodymium.

Unless otherwise indicated, all numbers expressing quantities of ingredients, reaction conditions, and so forth used in the specification and claims are to be understood as being modified in all instances by the term "about."

Preparation of the Radially-Zoned Substrates

The radially-zoned substrates of the present invention may be readily prepared by processes well known in the prior art. A representative process includes dipping the inlet and/or outlet end into a washcoat, utilizing a template or stencil to apply the coating to the desired outer radial area while leaving the inner radial area uncoated. It will be understood that the process below can be varied according to different embodiments of the invention.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

The invention has been described with specific reference to the embodiments and modifications thereto described above. Further modifications and alterations may occur to others upon reading and understanding the specification. It is intended to include all such modifications and alterations insofar as they come within the scope of the invention.

What is claimed is:

1. An exhaust gas treatment catalyst composite comprising:

a substrate comprising first and second pluralities of longitudinal passages wherein the first plurality of passages define an inner radial zone and the second plurality of passages define an outer radial zone, wherein internal surfaces of the first and second pluralities of longitudinal passages both comprise the same at least one catalytic layer comprising a catalytic metal on a support, and the second plurality of passages are configured such that more exhaust gas flows through the first plurality of passages as compared to the second plurality of passages, and wherein the internal surfaces of the second plurality of passages further comprise a layer comprising a trapping or absorbing material in the absence of precious metals.

2. The catalyst composite of claim 1, wherein the internal surfaces of the first plurality of passages are substantially free of the trapping or adsorbing material.

3. The catalyst composite of claim 1, wherein the internal surfaces of the first plurality of passages further comprise a layer comprising a trapping or adsorbing material in the absence of precious metals, and the second plurality of passages have a longer average axial length as compared to the first plurality of passages.

4. The catalyst composite of claim 1, wherein the internal surfaces of the first plurality of passages both further comprise a layer comprising a trapping or adsorbing material in the absence of precious metals, and the second plurality of passages have an average opening perimeter size that is smaller as compared to the first plurality of passages.

5. The catalyst composite of claim 1, wherein the outer radial zone comprises up to approximately 50% of the cross-sectional area of the substrate.

6. The catalyst composite of claim 5, wherein the layer comprising the hydrocarbon adsorbent begins from an inlet end of the substrate and extends axially for no less than the lesser of 1 cm or 20% of the substrate's length.

7. The catalyst composite of claim 1, wherein the trapping or adsorbing material comprises a hydrocarbon adsorbent.

8. The catalyst composite of claim 7, wherein the layer comprising the hydrocarbon adsorbent is located below the at least one catalytic layer.

9. The catalyst composite of claim 7, wherein the hydrocarbon adsorbent comprises a molecular sieve.

10. The catalyst composite of claim 9, wherein the molecular sieve comprises a zeolite selected from the group consisting of ZSM-5, Y-zeolite, beta-zeolites, and combinations thereof.

11. The catalyst composite of claim 1, wherein the trapping or adsorbing material comprises an oxygen storage component.

12. The catalyst composite of claim 11, wherein the layer comprising the oxygen storage component is located either above or below the at least one catalytic layer.

13. The catalyst composite of claim 11, wherein the layer comprising the oxygen storage component begins from an outlet end of the substrate and extends axially for no less than the lesser of 1 cm or 20% of the substrate's length.

14. The catalyst composite of claim 11, wherein the oxygen storage component is selected from the group consisting of ceria, praseodymia, and combinations thereof.

15. The catalyst composite of claim 1, wherein the average length of the second plurality of passages is longer than the average length of the first plurality of passages by 1 cm or 20% of the substrate's length, whichever is less.

16. A system for treatment of an internal combustion engine exhaust stream including hydrocarbons, carbon monoxide, and other exhaust gas components, the emission treatment system comprising:

an exhaust conduit in fluid communication with the internal combustion engine via an exhaust manifold; and the catalyst composite according to claim 1.

17. The system of claim 16, the internal surfaces of first plurality of passages are substantially free of the trapping or adsorbing material.

18. The system of claim 16, wherein the internal surfaces of the first plurality of passages further comprise a layer comprising a trapping or adsorbing material in the absence of precious metals, and the second plurality of passages have a longer average axial length as compared to the first plurality of passages.

19. The system of claim 16, wherein the internal surfaces of the first plurality of passages further comprise a layer comprising a trapping or adsorbing material in the absence of precious metals, and the second plurality of passages have an average opening perimeter size that is smaller as compared to the first plurality of passages.

20. The system of claim 16, wherein the catalyst composite consists essentially of the inner radial zone and the outer radial zone.

21. A method for treating exhaust gases comprising contacting a gaseous stream comprising hydrocarbons, carbon monoxide, and nitrogen oxides with the catalyst composite according to claim 1.

22. The catalyst composite of claim 1 consisting essentially of the inner radial zone and the outer radial zone.

23. The method of claim 20, wherein the catalyst composite consists essentially of the inner radial zone and the outer radial zone.

* * * * *